US007494114B1

(12) United States Patent
Hallman, Jr.

(10) Patent No.: US 7,494,114 B1
(45) Date of Patent: Feb. 24, 2009

(54) CONTROLLED DIFFERENTIAL PRESSURE SYSTEM FOR AN ENHANCED FLUID BLENDING APPARATUS

(75) Inventor: Russell Louis Hallman, Jr., Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 566 days.

(21) Appl. No.: 11/236,959

(22) Filed: Sep. 28, 2005

Related U.S. Application Data

(60) Provisional application No. 60/614,870, filed on Sep. 30, 2004.

(51) Int. Cl.
*B01F 3/04* (2006.01)

(52) U.S. Cl. ..... 261/130; 261/43; 261/64.3; 261/107

(58) Field of Classification Search ..... 261/42, 261/43, 64.3, 100, 107, 130
See application file for complete search history.

(56) References Cited

U.S. PATENT DOCUMENTS 3,521,865 A 7/1970 Kertzman
6,182,951 B1 2/2001 Hallman, Jr. et al.

*Primary Examiner*—Robert A Hopkins
(74) *Attorney, Agent, or Firm*—Michael J. Renner; Luedeka, Neely & Graham, P.C.

(57) ABSTRACT

A system and method for producing a controlled blend of two or more fluids. Thermally-induced permeation through a permeable tube is used to mix a first fluid from outside the tube with a second fluid flowing through the tube. Mixture ratios may be controlled by adjusting the temperature of the first fluid or by adjusting the pressure drop through the permeable tube. The combination of a back pressure control valve and a differential regulator is used to control the output pressure of the blended fluid. The combination of the back pressure control valve and differential regulator provides superior flow control of the second dry gas. A valve manifold system may be used to mix multiple fluids, and to adjust the volume of blended fluid produced, and to further modify the mixture ratio.

19 Claims, 5 Drawing Sheets

CONTROLLED DIFFERENTIAL PRESSURE SYSTEM FOR AN ENHANCED FLUID BLENDING APPARATUS

CROSS REFERENCES TO RELATED APPLICATIONS

This patent application claims priority from and is related to U.S. Provisional Patent Application Ser. No. 60/614,870 filed Sep. 30, 2004, entitled: Controlled Differential Pressure Manifold for an Enhanced Moisture Blending System. This U.S. Provisional patent application is incorporated by reference in its entirety herein.

GOVERNMENT RIGHTS

The U.S. Government has rights to this invention pursuant to contract number DE-AC05-000R22800 between the U.S. Department of Energy and BWXT Y-12, L.L.C.

FIELD

This invention relates to the field of fluid blending systems. More particularly, this invention relates to the control of the percentage of a first fluid, such as water vapor, in a mixture with a second fluid, such as air.

BACKGROUND

Many applications in science and industry require an apparatus that creates a controlled amount of a fluid introduced into another fluid. For instance, some material corrosion testing applications require such an apparatus to determine the reaction of a material over time upon exposure to a controlled corrosive vapor-gas mixture. Tests are typically performed using a higher vapor concentration of the vapor-gas mixture, in an effort to decrease the duration of the test. Data are then extrapolated to model the material's reaction over time. However, because the results are extrapolated, any error caused by an imprecisely controlled vapor-gas mixture will be magnified. Thus, an apparatus that creates a controlled testing environment with a gas having a precise flow rate and a precisely controlled vapor-gas mixture is critical to ensure the accuracy of these types of tests.

U.S. Pat. No. 6,182,951—"Method and apparatus for providing a precise amount of gas at a precise humidity," Hallman, Jr., et al., disclosed a system for controlling the percentage of a fluid mixed with another fluid. However, the system disclosed therein is affected by changes in pressure or flow rate that occur in the process application to which the system is connected. Such variations affect the mixture percentage. What is needed, therefore, is an improved system that is less sensitive to changes in process pressures and flow rates.

SUMMARY

In the present invention a system is disclosed for providing blended fluids at a specified minimum delivery pressure. The system includes a differential pressure regulator having a high pressure side, a low pressure side, and a pressure reference port. A second fluid source containing a second fluid at a second fluid pressure is provided, where the second fluid source is connected to the high pressure side of the differential pressure regulator. The system further comprises at least one controlled temperature reservoir with each controlled temperature reservoir containing a first fluid at a controlled first fluid temperature. There is an output line having an output line first end and an output line second end. There is at least one fluid carrier with each fluid carrier having a permeable section and with each fluid carrier having a fluid carrier first end and a fluid carrier second end. The fluid carrier first end of each fluid carrier is connected to the low pressure side of differential pressure regulator, and a portion of each permeable section is immersed in at least one controlled temperature reservoir. The fluid carrier second end of each fluid carrier is connected to the output line first end so that, as the second fluid passes through the portion of each permeable section of fluid carrier that is immersed in the first fluid in the controlled temperature reservoir, a portion of the first fluid passes through the permeable section of the fluid carrier and mixes with a portion of the second fluid forming a blended fluid that flows from the fluid carrier second end into the output line first end at a blended fluid output pressure. The system also incorporates a back pressure control valve that is tapped into the output line. The back pressure control valve is set at a back pressure that is at least equal to the specified minimum delivery pressure. Further, there is a pilot tube having a pilot tube first end and a pilot tube second end, where the pilot tube first end is tapped into the output line, and the pilot tube second end is connected to the pressure reference port of the differential pressure regulator. In this configuration the blended fluid output pressure remains substantially constant and blended fluid flows from the output line second end at a volumetric mixture ratio that is substantially determined by the first fluid temperature of each controlled temperature reservoir.

The invention further provides a method for providing an application process with a blend of fluids having a specified volumetric flow rate and having a specified volumetric ratio of a second fluid in a mixture with a first fluid at a specified minimum delivery pressure. The method begins by controlling the temperature of a reservoir of a first fluid and then flowing a second fluid at a second fluid supply pressure into a permeable fluid carrier and passing the second fluid in the permeable fluid carrier through the reservoir. The method continues with thermally inducing permeation of a portion of the first fluid into the flow of the second fluid thereby producing a blended fluid flow exiting the permeable fluid carrier. Subsequent steps are setting a blended fluid output pressure that is at least equal to the specified minimum delivery pressure and maintaining a fixed pressure differential between the second fluid supply pressure and the blended fluid output pressure. The method concludes by flowing the blended fluid from the permeable fluid carrier to the application process.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
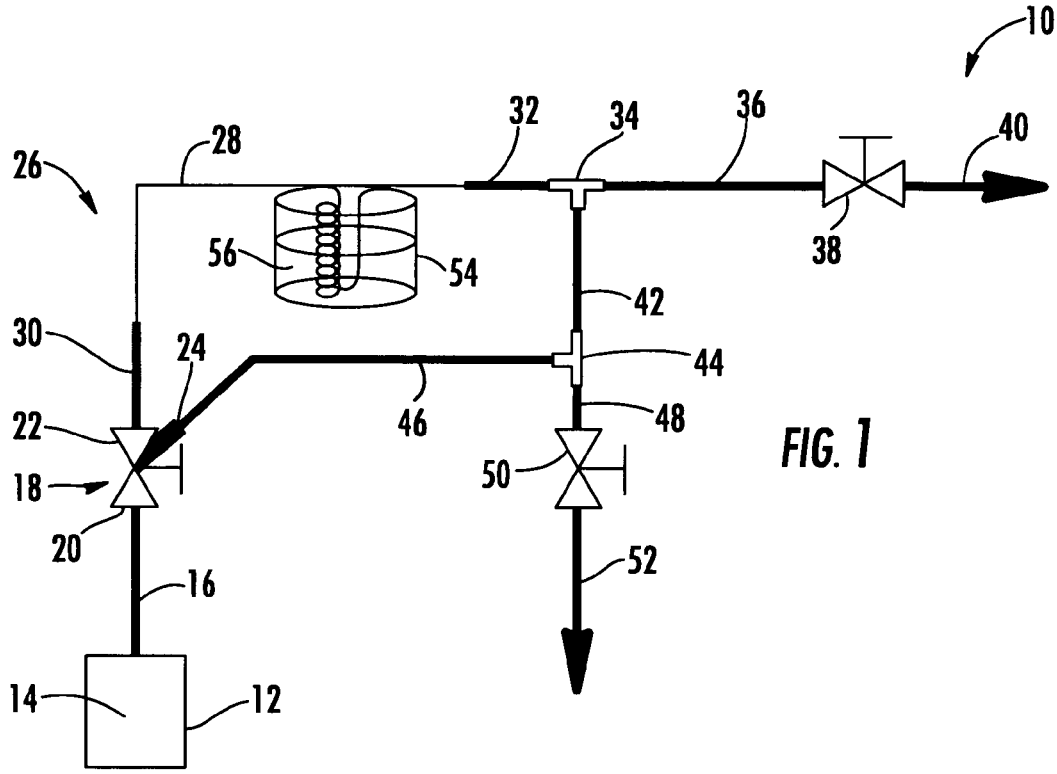
FIG. 1 is a schematic diagram of a fluid blending system according to the invention.

There are many industrial and experimental application processes that require a mixture of two or more fluids in a precise ratio. Furthermore, most application processes require that the mixture be provided at a pressure that does not drop below a specified minimum pressure. One example of such an application process is a requirement for a precise amount of moisture in a gas. In order to make a device that will deliver a gas, such as nitrogen, with a precise amount of moisture upon demand, two things are needed: (1) an exact amount of dry gas and (2) an exact amount of moisture. To accomplish this, a basic moisture blending system consists of a water reservoir, and a pressure regulator delivering dry nitrogen through a permeation tube that is at least in part submerged in the water reservoir. If the temperature of the water in the water reservoir is constant, water vapor mixes with the dry gas flowing through the permeation tube at a constant rate. This water vapor is an example of a "permeated fluid" in a fluid blending system. As a principle of physics, if a gas at a fixed pressure is applied to the entrance of a long tube and the output pressure is fixed, such as at atmospheric pressure, then the flow rate of the gas through the tube is simply a function of the pressure drop across the tube. Quantitatively, the flow rate, $Q_V$, is equal to $\Delta P/R_F$, where $\Delta P$ is the pressure drop and $R_F$ is the fluid resistance in the tube. $R_F$ is a function of the cross-sectional area of the tube, the tube's length, and the viscosity of the fluid, all of which are substantially constant for a particular moisture blending system setup. Thus, in preferred applications, the flow rate of the bulk dry gas (to which the moisture is added) is controlled by the pressure drop across the permeation tube's length.

The moisture content of a water/gas mixture may be measured several ways. One of the easiest ways is to measure the dew point of the mixture. This works because the dew point is a function of the partial pressure of the water in the mixture, and the partial pressure of the water in the mixture is a function of the number of molecules of water in a given volume. The volumetric ratio of water vapor to dry gas is also proportional to the partial pressures of the water vapor and the dry gas. Moisture content is sometimes expressed in parts per million (ppm). 500 ppm means there are 500 unit volumes of water vapor for one million unit volumes of gas solution. The gas solution consists of 500 units of water vapor and 999,500 units of other gas for a total of 1,000,000 units. Concentrations expressed in ppm are traditionally interpreted to mean volumetric concentrations. However, to avoid any ambiguity about whether ppm refers to a volumetric ratio or a mass ration, the concentration may be specifically labeled ppm(v) or ppm(m). To convert ppm(v) to ppm(m) the equation is as follows for a solution of 500 ppm(v) of (A) in a solution of (A+B):

$$\text{ppm}(m)=[500*(mwA)/(500*(mwA)+999{,}500*(mwB))]*1{,}000{,}000 \quad \text{[Eq'n 1]}$$

Restated for clarity, the solution consists of 500 volumetric parts (A) and 999,500 volumetric parts (B) for a total of 1,000,000 parts of solution. If the molecular weight of (A) is 18 (i.e., mwA, =18) and the molecular weight of (B) is 40 (i.e., mwB, =40) then the parts per million mass is:

$$\text{ppm}(m)=[(500*18)/(500*18+999{,}500*40)]*1{,}000{,}000=225\ \text{ppm}(m) \quad \text{[Eq'n 2]}$$

Many industrial applications require the blending of permeable vapors other than moisture. The same principles described for the moisture blending system may be applied in such applications. For example, alcohols, chlorinated solvents, hydrocarbons, and nearly any other liquid with a significant vapor pressure may be blended using this system. For applications requiring very high blend ratios, i.e., where the introduction of very small but controlled amounts of vapors is needed, the permeation tube can be placed in a temperature-controlled vapor chamber instead of a liquid reservoir.

In a moisture blending system, the amount of moisture added is a function of water vapor (moisture) permeation through the tube wall. The rate of permeation through the permeation tube wall is established by the solubility of water in the tube wall and diffusion through the tube wall, the concentration of water in the reservoir (which is 100% for a liquid water reservoir), the length of tube that is immersed in the water reservoir, and the temperature of the water. In the preferred applications the length of tube immersed in the water is held constant and the rate of permeation is modified by varying the temperature. As the temperature is increased the rate at which moisture is transported to the dry bulk gas is increased. This process is referred to as thermally-induced permeation, and the rate of thermally-induced permeation is controlled by varying the temperature set point of the thermal regulation system. That is, thermally-induced permeation through a permeable tube is used to mix a first fluid from outside the tube with a second fluid flowing through the tube. The relationship between moisture content (in ppm) and water reservoir temperature is not linear, but it can be easily plotted by measuring the output of the moisture blending system over a range of water temperatures. There are commercial controlled temperature reservoirs having thermal regulation systems that can maintain a very accurate temperature control. For example, a model F494 made by Brozelco can control temperatures within +/−0.1° C. In some embodiments satisfactory control of a temperature reservoir may be achieved by stabilizing the first fluid temperature at controlled room temperature. The required temperature control tolerance for a particular fluid blending system setup is dependent upon the stability in the volumetric ratio between the blended fluids that is required by the application process. For example, if it is determined that in the range of operation of a particular moisture blending system a 5° C. temperature change results in a 5 ppm change in moisture content, and it is desired to control the moisture content to +/−1 ppm, then the temperature of the water should be controlled to a range of no more than +/−1° C. Note that changing the volumetric ratio of a blended fluid changes the volumetric flow rate, but the effect of change in volumetric flow rate is generally inconsequential except in high moisture content systems. For example, changing from one part per million moisture to 10 parts per million moisture changes the volumetric flow rate by 9/1,000,000.

As a result of these physical properties, a basic moisture blending system introduces a fixed amount of moisture into a fixed amount of dry gas, resulting in a consistent stream of gas with a constant amount of moisture. To increase the concentration of moisture delivered by such a system, either the amount of water mixed with the dry gas may be increased (for the same amount of dry gas), or the amount of dry gas may be decreased (for the same amount of water). In preferred embodiments, the amount of water mixed with the dry gas is increased by increasing the temperature of the water reservoir and the amount of water mixed with the dry gas is decreased by decreasing the temperature of the water reservoir. In preferred embodiments the amount of dry gas picking up a fixed quantity of water is increased by increasing the pressure drop across the tube and the amount of dry gas picking up a fixed quantity of water is decreased by decreasing the pressure drop across the tube. In such systems, the pressure at the entrance of the tube is produced by a standard pressure regulator and the output pressure is fixed at either atmospheric pressure or some other pressure resulting from the application process connected to the output of the tube.

The basic fluid blending system just described, and which is further detailed in U.S. Pat. No. 6,182,951—"Method and apparatus for providing a precise amount of gas at a precise humidity," Hallman, Jr., et al., works very well in many applications. However, when such a fluid blending system is connected to an application process that undergoes changes in pressure and/or flow rate, the blending characteristics of the fluid blending system change and the permeated fluid characteristics vary because of the change in the gas flow rates. These problems are resolved, with additional benefits realized, by the introduction of a back-pressure control valve and a pressure regulator equipped with a pilot line being added to the fluid blending system. Such a fluid blending system has the ability to supply a constant permeated fluid content gas stream at a specified minimum delivery pressure while accommodating variations in the application process pressure and flow rates. This design has several additional advantages that include no overshoot with set point changes, long term stability, and very good reproducibility between systems manufactured to the same design.

An embodiment that incorporates a back pressure control valve is illustrated in FIG. 1. A fluid blending system 10 comprises a second fluid source 12 that contains a second fluid 14. Second fluid 14 leaves second fluid source 12 and is fed through a feed line 16 to a standard commercial differential pressure regulator 18. The most preferred embodiments employ a dome pressure control valve from Veriflo, model IR5001S1K3P032D, part number 54012780. Veriflo is a division of Parker instruments. Differential pressure regulator 18 has a high pressure side 20, a low pressure side 22, and a pressure reference port 24. Differential regulators such as differential pressure regulator 18 are designed to produce a fluid pressure at the low pressure side 22 that is a set fixed pressure amount greater than the fluid pressure at the pressure reference port 24. Second fluid 14 leaves differential pressure regulator 18 through a fluid carrier 26. In this embodiment, fluid carrier 26 has a first impermeable section 30 and a second impermeable section 32 with a permeable section 28 between first impermeable section 30 and second impermeable section 32. Second impermeable section 32 is connected to first tee 34. In alternate embodiments fluid carrier 26 may have only a permeable section 28 that is connected directly between differential pressure regulator 18 and first tee 34.

Output line 36 is also connected to first tee 34, and output line 36 is also connected to process valve 38. Process feed line 40 is also connected to process valve 38. Coming out of the third branch of first tee 34 is process control line 42, which feeds into second tee 44. Pilot line 46 emerges from one of the other branches of second tee 44 and pressure control line 48 emerges from the third branch of second tee 44. Pressure control line 48 is connected to back pressure control valve 50, which is set at a back pressure value. The most preferred embodiments employ a Veriflo back pressure control valve model ABP3SV23BP0321, part number 44200430. The output of back pressure control valve 50 is connected to exhaust line 52. A portion of permeable section 28 of fluid carrier 26 is configured inside control temperature reservoir 54, and a portion of permeable section 28 is immersed in first fluid 56 which is resident in control temperature reservoir 54, where first fluid 56 is maintained at a first fluid temperature.

In operation, second fluid 14 exits second fluid source 12 and flows through feed line 16 to differential pressure regulator 18. Second fluid 14 then flows at a second fluid rate and at a second fluid pressure into the first impermeable section 30 of fluid carrier 26. When second fluid 14 passes through the portion of permeable section 28 that is immersed in first fluid 56, an amount of first fluid 56 is mixed with second fluid 14 creating a blended fluid at a volumetric mixture ratio. The volumetric mixture ratio is the volume ratio of first fluid 56 divided by the sum of the volumes of first fluid 56 plus second fluid 14. The blended fluid leaves permeable section 28 and enters second impermeable section 32 at a blended fluid output rate and blended fluid output pressure.

The operation of fluid blending system 10 is further controlled by the back pressure setting of back pressure control valve 50. The back pressure is set at a pressure that is equal to or greater than the minimum desired blended fluid output pressure supplied to an application process through process valve 38 and process feed line 40. In the most preferred embodiments, the input port of back pressure control valve 50 is close enough to the input port of process valve 38 that the pressure at both locations is substantially the same. In that configuration, the pressure setting of back pressure control valve 50 sets the blended fluid output pressure. If the back pressure control valve 50 is physically distant from the input port of process valve 38, or if output line 36 and/or process control line 42 has a pressure drop, then differences in pressures between back pressure control valve 50 and process valve 38 need to be accounted for in the back pressure setting of the back pressure control valve 50.

Back pressure control valve 50 maintains a fixed pressure down stream from the fluid carrier 26. The pilot line 46 provides a means for the differential pressure regulator 18 to sense the down stream pressure and thereby maintain a fixed pressure upstream from the fluid carrier 26. The cooperative combination of these two pressure regulators maintains a fixed pressure drop across the entire permeable section 28 of fluid carrier 26, and in particular, the combination maintains a fixed pressure drop across the portion of permeable section 28 that is immersed in first fluid 56. That fixed pressure drop, together with a fixed first fluid temperature, ensures a substantially fixed volumetric mixture ratio. To adjust the blended fluid output rate the pressure drop across the fluid carrier 26 may be changed. A higher pressure differential will increase the blended fluid output rate and a lower pressure differential will decrease the blended fluid output rate. Of course increasing the differential pressure across the fluid carrier 26 increases the second fluid volumetric flow rate, but the rate of permeation of the first fluid remains the same. As a result, the volumetric mixture ratio changes. The first fluid temperature may then be adjusted to achieve the desired volumetric mixture ratio.

It was previously stated that the back pressure control valve 50 should be set at a pressure that is equal to or greater than the desired delivery pressure because most application processes have some device such as a valve or regulator that throttles either the pressure and/or flow rate being introduced into the application process based on demand of the process. (However, for those application processes that specify a desired delivery pressure and cannot tolerate and have no means to regulate higher pressures, then the BPCV should be set equal to the desired delivery pressure.) Any pressure greater than the desired delivery pressure will provide a reserve to meet times of high demand or quick response. For example, if an application process needs a minimum of 10 psi but it occasionally needs higher pressures, then the range of available blended fluid output pressure can be increased simply by increasing the setting on the back pressure control valve 50. To illustrate this, suppose that initially that back pressure control valve 50 is set to "0" psi (gauge) back pressure, meaning that it is set to atmospheric pressure (approximately 15 psi absolute pressure). Suppose further that differential pressure regulator 18 is set to maintain a 15 psi gauge pressure level above the back pressure (which corresponds to 30 psi absolute pressure). In this configuration the pressure at the low pressure side 22 of differential pressure regulator 18 will be the difference between the back pressure control valve 50 setting and the differential pressure regulator setting, or 15 psi. (That assumes a sufficiently high pressure of second fluid 14 in second fluid source 12, which in this case would have to be higher than 30 psi absolute pressure.)

Now, suppose back pressure control valve 50 is reset to 15 psi gauge back pressure (i.e., approximately 30 psi absolute pressure). That new pressure setting is fed back to differential pressure regulator 18 through pilot line 46, and differential pressure regulator 18 increases the fluid pressure at lower side 22 by the fixed amount of 15 psi to a new level of 30 psi gauge (45 psi absolute). The pressure drop across the fluid carrier 26 is not changed (it remains at 15 psi) so the volumetric flow rate of the bulk gas remains constant (while doubling the mass flow rate because of the doubling of the back pressure), and the available blended fluid output pressure is now 15 psi gauge or 30 psi absolute. It should be noted that the moisture permeation rate has not changed since the first fluid 56 temperature has not changed, but the moisture content is now half of its former amount because the mass flow rate has doubled due to the doubling of the back pressure.

Figure 1A:
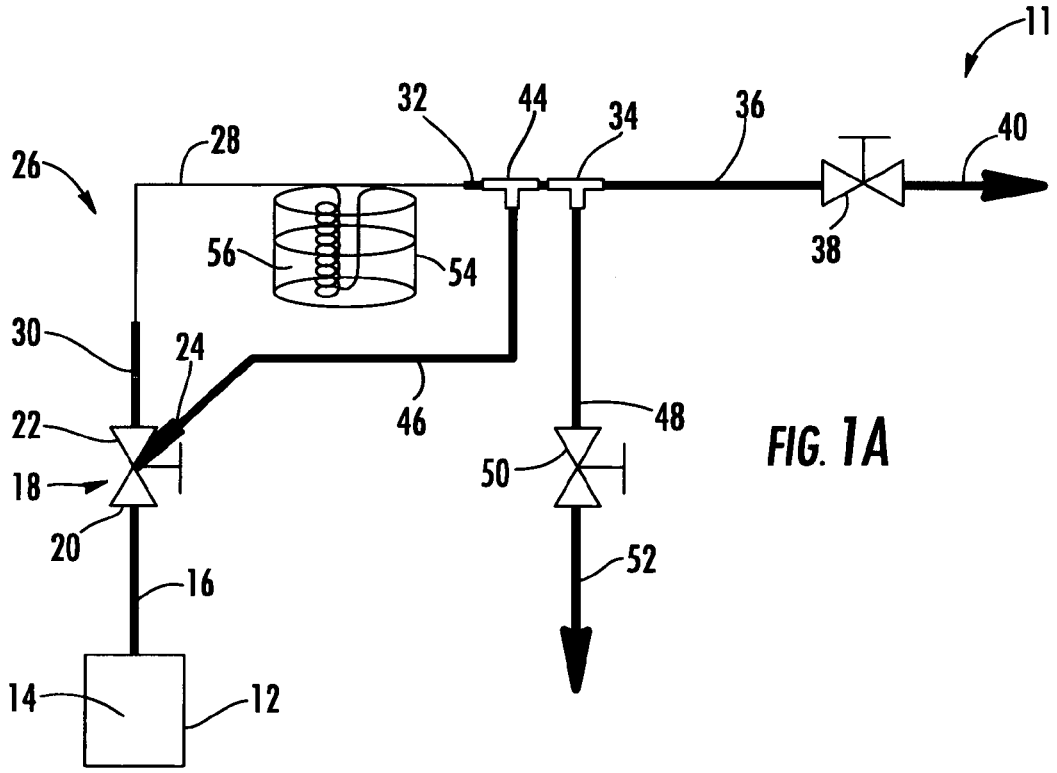
FIG. 1A is a schematic diagram of an alternative embodiment fluid blending system according to the invention.

FIG. 1 illustrates an example of a structure wherein the pilot line (i.e., the pilot line 46) is "tapped into" output line 36 via first tee 34, process control line 42, and second tee 44. FIG. 1 also illustrates an example of a structure whereby the back pressure control valve 50 is "tapped into" output line 36. Back pressure control valve 50 is tapped into output line 36 via first tee 34, process control line 42, second tee 44 and pressure control line 48. An alternate configuration whereby the pilot line 46 and back pressure control valve 50 may be tapped into output line 36 is depicted by fluid blending system 11 illustrated in FIG. 1A. In fluid blending system 11, second tee 44 is removed from the process control line 42 of FIG. 1 and then pressure control line 48 is connected directly to first tee 34. Second tee 44 is connected between second impermeable section 32 and the remaining (third) branch of first tee 34 and pressure control line 48 is connected to the remaining (third) branch of first tee 34. There is an advantage to keeping the process tubing bore diameter as close as possible to the bore diameter of the permeation tube and as short as possible throughout a fluid blending system, because this results in less surface area for adsorption of permeated fluid and excess holdup volume in the system which can affect the speed at which the system will come to a steady state after a change in the permeated fluid level. Within these parameters there are many alternative ways for tapping the pilot line (46) and back pressure control valve 50 into output line 36.

Figure 2:
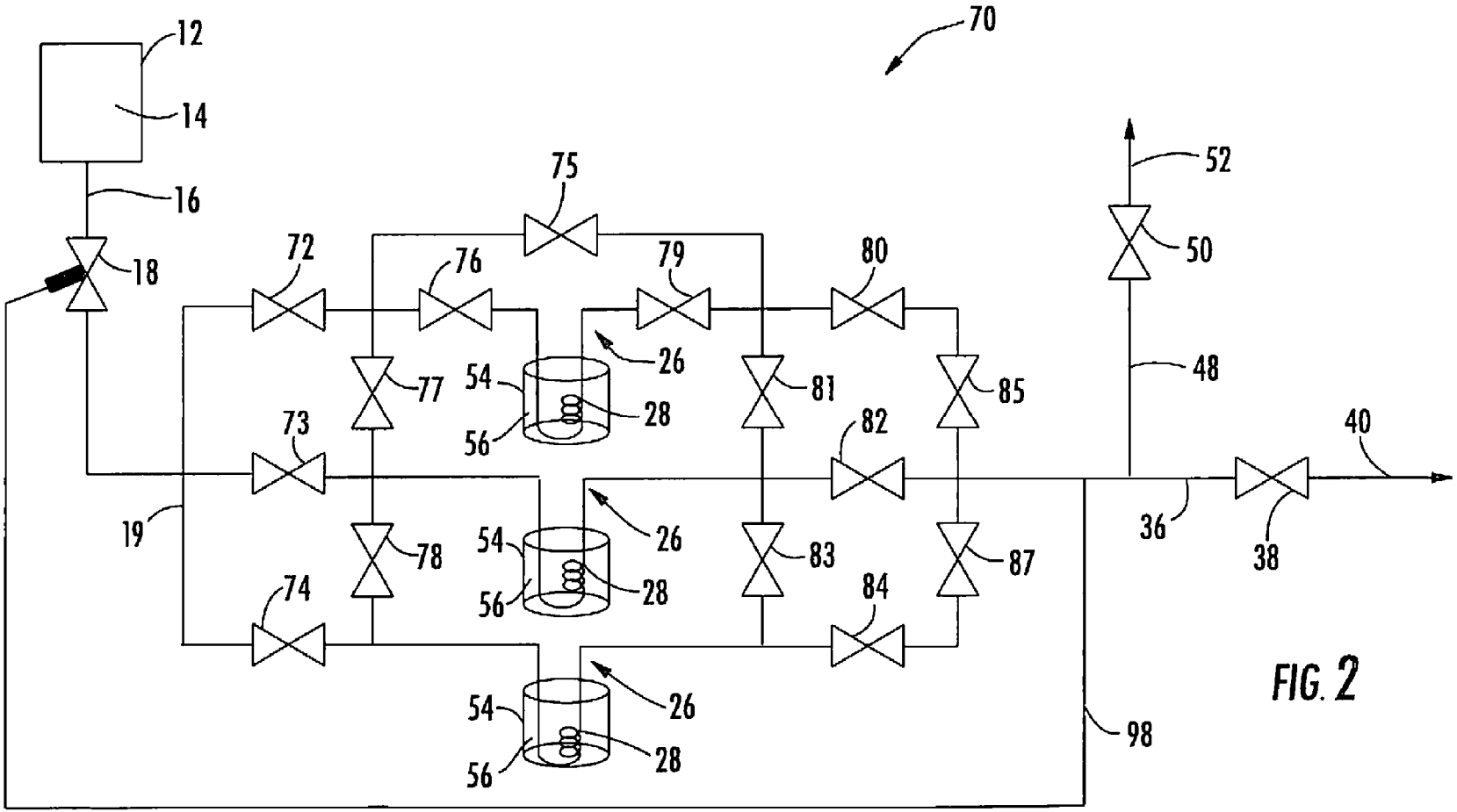
FIG. 2 is a schematic diagram of an alternative embodiment of the invention.

FIG. 2 illustrates an alternate embodiment of a fluid blending system 70. To provide for a wider range of flows and permeated fluid contents, fluid blending system 70 incorporates a manifold system that allows a user to select parallel or series configurations of multiple permeation tubes. Fluid blending system 70 is illustrated with only three permeation tubes, but the concept can be extended to more than three tubes. Fluid blending system 70 comprises a second fluid source 12 that contains a second fluid 14. Second fluid 14 leaves second fluid source 12 and is fed through a feed line 16 to a standard commercial differential pressure regulator 18. Second fluid 14 leaves differential pressure regulator 18 through line 19 and enters input manifold valves 72, 73, and 74 at a second fluid rate and at a second fluid pressure. Three controlled temperature reservoirs 54 containing first fluids 56 may be connected to one or more of the input manifold valves 72, 73, and 74 through various alternate configurations of valves 76, 77 and 78. The first fluid temperature in each controlled temperature reservoir may be maintained by a thermal regulation system built into the controlled temperature reservoir. Alternately, the first fluid temperature in each controlled temperature reservoir may be maintained by stabilizing each controlled temperature reservoir at a controlled room temperature. Such configurations may be preferred in cases where power is not available or its use is not desired. In configurations where each controlled temperature reservoir is maintained at the same temperature, the overall permeated fluid content may be varied by employing permeable sections 28 consisting of different materials, different lengths, different tube diameters and tube wall thicknesses, etc. The overall permeated fluid content may then be further varied by alternate parallel and series flow patterns established by different valve manifold settings.

A portion of permeable section 28 of each of three fluid carriers 26 is configured inside control temperature reservoirs 54, and a portion of permeable section 28 is immersed in first fluid 56 which is resident in each control temperature reservoir 54. In this embodiment, all the first fluid 56 is maintained at a first fluid temperature. In alternate configurations, first fluids 56 may be maintained at different first fluid temperatures, and first fluids 56 may comprise two or more different fluids. Blended fluid exits the controlled temperature reservoir configuration through various alternate configurations of valves 75, 79, 80, 81, 82, 83, 84, 85, and 87, which are collectively referred to as the output manifold, eventually exiting through output line 36. Pressure line 48 is tapped into output line 36 and pressure line 48 is connected to back pressure control valve 50. A pilot line 98 is also tapped into output line 36 and pilot line 98 is connected to differential pressure regulator 18, thereby establishing a fixed pressure drop across the fluid carriers 26. Process valve 38 is fed by output line 36, and blended fluid is provided to an application process through process feed line 40.

The manifold system is set up in a manner that allows the dry gas to be passed directly to the downstream system for drying of the system or through any combination of tubes to develop stepwise changes in the flow rate and/or permeated fluid content. For example, if all valves are closed except valves 18, 72, 75, 80, 85, and 38 then a stream of dry gas will be delivered at the maximum flow rate that the system is capable of delivering. If the flow is directed through valves 18, 74, 84, 87, and 38 then the gas will be restricted by one permeable section 28 and will pick up the permeated fluid permitted only by that tube at its temperature. If a higher permeated fluid content is desired then the flow can be directed through valves 18, 74, 83, 77, 75, 80, 85, and 38. Because second fluid 14 then flows through two permeable sections 28, this configuration doubles the permeated fluid pickup and the flow restriction assuming that the first and second permeation tubes 28 are alike. If the permeated fluid content delivered by a single pass through a tube is needed, but at twice the flow rate, then valves 18, 73, 78, 83, 82, and 38 can be opened. That configuration allows the passage of gas through the bottom two permeable sections 28 in parallel.

The concept of parallel and series configurations can be used to generate a whole range of flows and permeated fluid contents at a fixed temperature. To the extent that second fluid 14 (or blended fluid) passes through fluid carriers 26 in parallel, the blended fluid output rate increases. To the extent that the second fluid 14 (or blended fluid) passes through fluid carriers 26 in series, the volumetric mixture ratio increases. If a desired flow rate is achieved and a small adjustment in volumetric mixture ratio is needed, the operator can adjust the first fluid's temperature.

There are several important factors regarding the process using the blended fluid that need to be considered in the design of a fluid blending system. In particular, it is important to know the maximum pressure that will be applied by the process to the output line of the fluid blending system. The blended fluid system should be designed to ensure that the blended fluid output pressure is greater than the maximum pressure applied by the process. If the operating pressure of the application process that is being fed by process feed line 40 is greater than the blended fluid output pressure, then the mixture of blended fluid will flow from second impermeable section 32 (FIG. 1 and FIG. 1A) out the back pressure control valve 50. Also, it is important to know the maximum volumetric rate at which the process expects to receive the blended fluid, and design the fluid blending system to produce blended fluid at a rate at least as great as the maximum process usage rate at the designed process operating pressure. If the operating process draws blended fluid at a rate that exceeds the capacity of the fluid system blending system, the drop in pressure below the designed operating pressure of the back pressure control valve 50 will result in a high delta pressure across the entire fluid blending system 70 and thus an increase in the bulk gas flow rate and a decrease in the permeated fluid content of the mixture.

Continuing in reference to FIG. 2, the most preferred embodiments incorporate a process valve 38. Process valve 38 permits the supply of blended fluid to be turned on and off without affecting the volumetric mixture ratio. When the application process does not need blended fluid then process valve 38 is turned off (called the standby mode) so that all of the blended fluid output is diverted to the back pressure control valve 50 which expels the blended fluid through exhaust line 52. This mode of operation does not affect the blended fluid output pressure, so the volumetric mixture ratio is unchanged. When the application process needs blended fluid then process valve 38 is opened (called the operational mode) so that some portion of the blended fluid is provided to the application process through process feed line 40. This mode of operation does not affect the blended fluid output pressure at output line 36 provided the volume supplied through valve 38 does not exceed the maximum flow rate of the system, so the volumetric mixture ratio remains unchanged. In the operational mode the flows through valves 38 and 50 sum to a constant total flow rate although the proportions may vary from 0:100% to 100:0%. If the flow through valve 38 exceeds the flow rate normally produced by the pressure drop as governed by the back pressure control valve 50 then the output pressure must drop as the output flow increases. This would upset the blending ratio by providing more dry gas for the same amount of permeated fluid resulting in a lower permeated fluid content. While in the operating mode, the internal operating pressure of the application process is "fed back" to the fluid blending system through process feed line 40, and the internal operating pressure of the application process may vary. As long as the blended fluid system 70 (or blended fluid system 10 in FIG. 1) is designed so that the blended fluid output pressure is greater than the maximum internal operating pressure of the application process, variations in the internal operating pressure of the application process do not affect the blended fluid output pressure, so the volumetric mixture ratio remains unchanged during such variations in the application process. Thus, fluid blending system (70 in FIG. 2 or 10 in FIG. 1) is able, within its capacity, to provide a variable amount of blended fluid to an application process while maintaining the blended fluid at a fixed volumetric mixture ratio.

Figure 3:
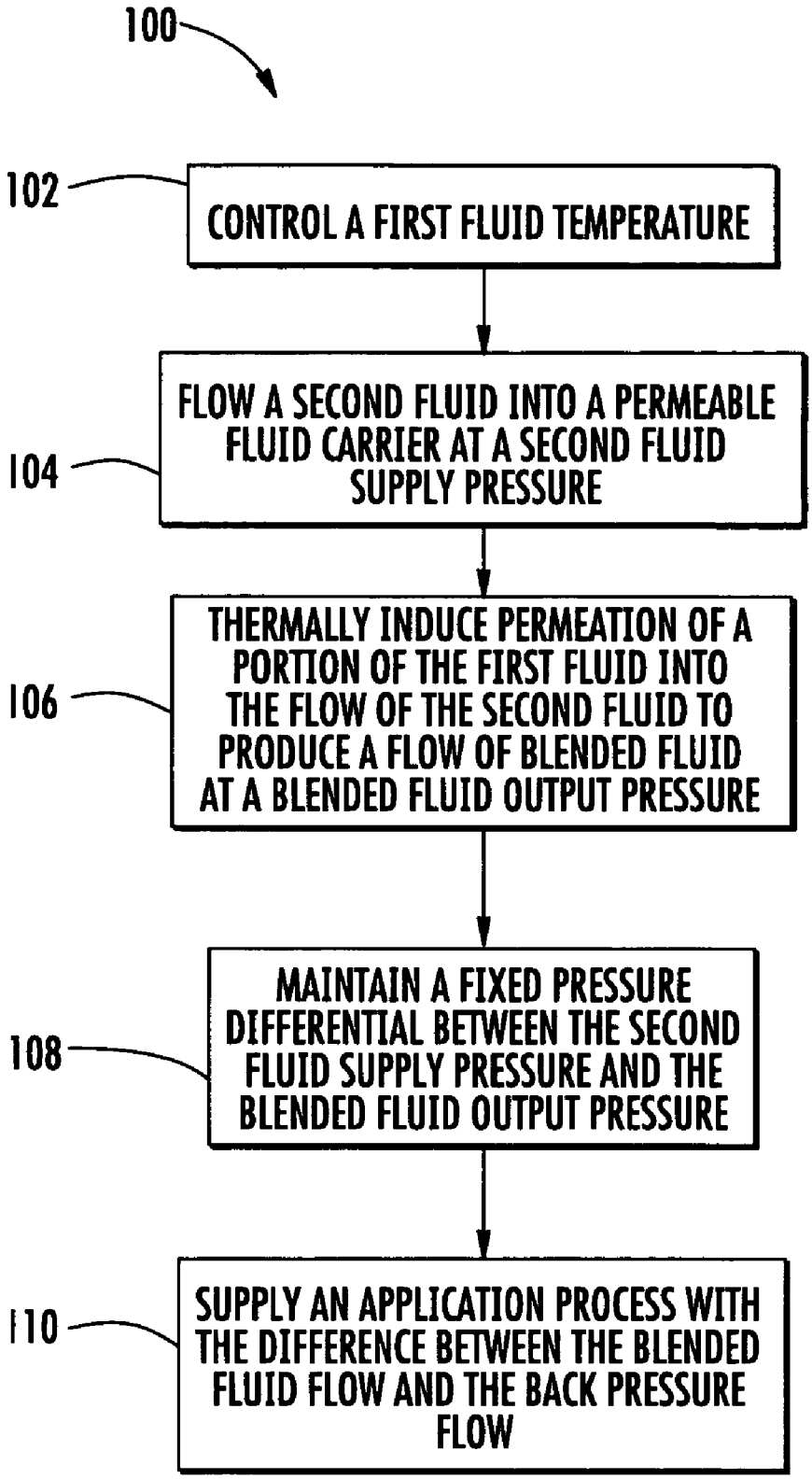
FIG. 3 is a flow chart of a method according to the invention.

FIG. 3 illustrates a method 100 for providing a process application with a blend of fluids. The method begins by controlling the temperature of a first fluid, step 102, where the first fluid is contained in a reservoir and preferably maintained at a controlled temperature. Then in step 104, flow of a second fluid is established in a permeable fluid carrier at a second fluid supply pressure. In step 106 the portion of the first fluid that permeates the permeable fluid carrier is mixed with the second fluid using thermally induced permeation, with blended fluid being produced at a blended fluid output pressure. A fixed pressure differential between the second fluid supply pressure and the blended fluid output pressure is maintained in step 108. According to step 110, the application process then receives the blended fluid at a pressure that is equal to or greater than the specified minimum delivery pressure.

Figure 4:
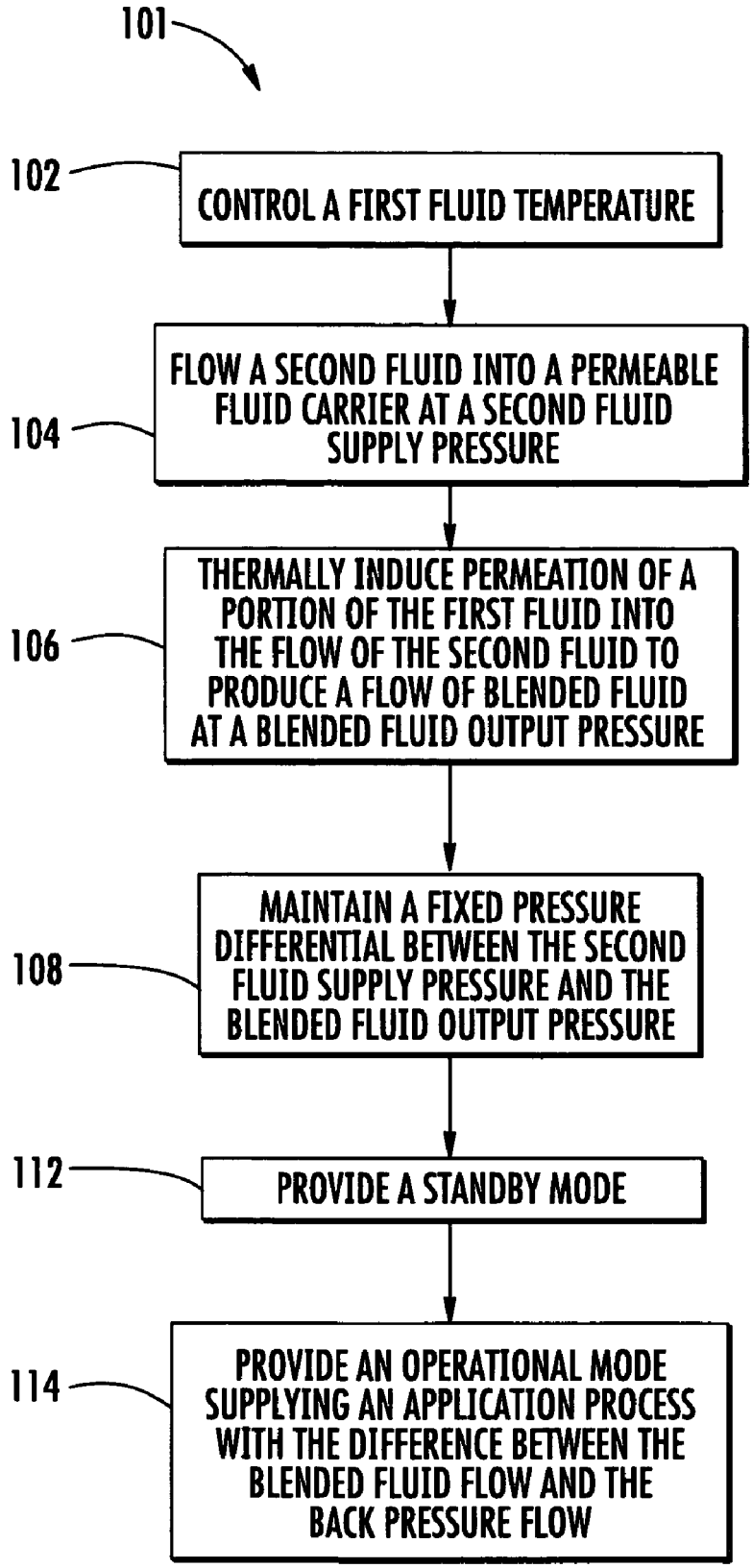
FIG. 4 is a flow chart of an alternate method according to the invention.

FIG. 4 illustrates an alternate method 101 for providing a process application with a blend of fluids. Steps 102 through 108 are equivalent to the same numbered steps depicted and described for method 100 of FIG. 3. However in method 101, following step 108 (which maintains a fixed pressure differential between the second fluid supply pressure and the blended fluid output pressure), step 112 is introduced which provides a standby mode for the method. Then in step 114 an operational mode is provided such that the application process receives blended fluid at a pressure that is equal to or greater than the specified minimum delivery pressure.

EXAMPLE 1

A basic fluid blending system was constructed using readily available commercial components. The system was a moisture blending system. The following test setup is described, and experimental results are presented, to illustrate how moisture content may be controlled by the second fluid temperature. A 1.5 standard cubic feet per hour (SCFH) system was constructed using a 30 mil ID×1/16 inch OD high pressure liquid chromatography (HPLC) capillary tube 20 feet in length as the fluid carrier. This was a 1520G FEP HPLC tube from Upchurch Scientific. All other lines in the system were stainless steel or other non-permeable material. The fluid carrier tube was connected to a pressure regulator via a swaged stainless steel compression fitting, and a rotameter (volume flowmeter) was connected in series with the pressure regulator. No back pressure control valve was used in this experiment. For verification of performance, the output of the fluid carrier was fed to a General Eastern dew point hygrometer. The flow rate through the capillary tube was nearly linear with respect to pressure in the flow range investigated. When 10 psi was applied, a flow rate of ~1.0 SCFH was observed and when ~15 psi was applied a flow rate of 1.5 SCFH was observed. No fluctuations in flow were observed over time through the tube. The tube is then submerged in a temperature controlled water reservoir. The bath used was a VWR brand bath model 1150A and is specified in the catalog as having a temperature control of ±0.05° C. The drift of the bath's temperature is important since temperature is the major controlling parameter of the water's permeation rate.

A 15 psi pressure drop and a flow rate of 1.5 SCFH was established, and the temperature of the bath was varied. Table 1 shows the variation in moisture content over a range of temperatures.

TABLE 1

| Temperature (degree C.) | Content (PPM) |
|---|---|
| 35 | 19 |
| 40 | 21 |
| 45 | 30 |
| 50 | 42 |
| 55 | 60 |
| 60 | 82 |

EXAMPLE 2

An alternate fluid blending system was built according to the following description. The following test setup is described, and experimental results are presented, to illustrate the stability of moisture content as the second fluid temperature is varied. The system was constructed using a 20 mil ID×1/16 inch OD Teflon high pressure liquid chromatography (HPLC) capillary tube 4 feet 3 inches in length as the fluid carrier. This was a 1548 FEP Teflon HPLC tube from Upchurch Scientific. The system was designed to deliver, upon demand, up to 200 cc/min with a total gas pass through of ~450 cc/min. All other lines in the system were stainless steel or other non-permeable material. The fluid carrier tube was connected to a pressure regulator via a swaged stainless steel compression fitting. A rotameter (volume flowmeter) was connected in series with the output to monitor gas flow. For verification of performance, the output of the fluid carrier was fed to a General Eastern dew point hygrometer.

Figure 5:
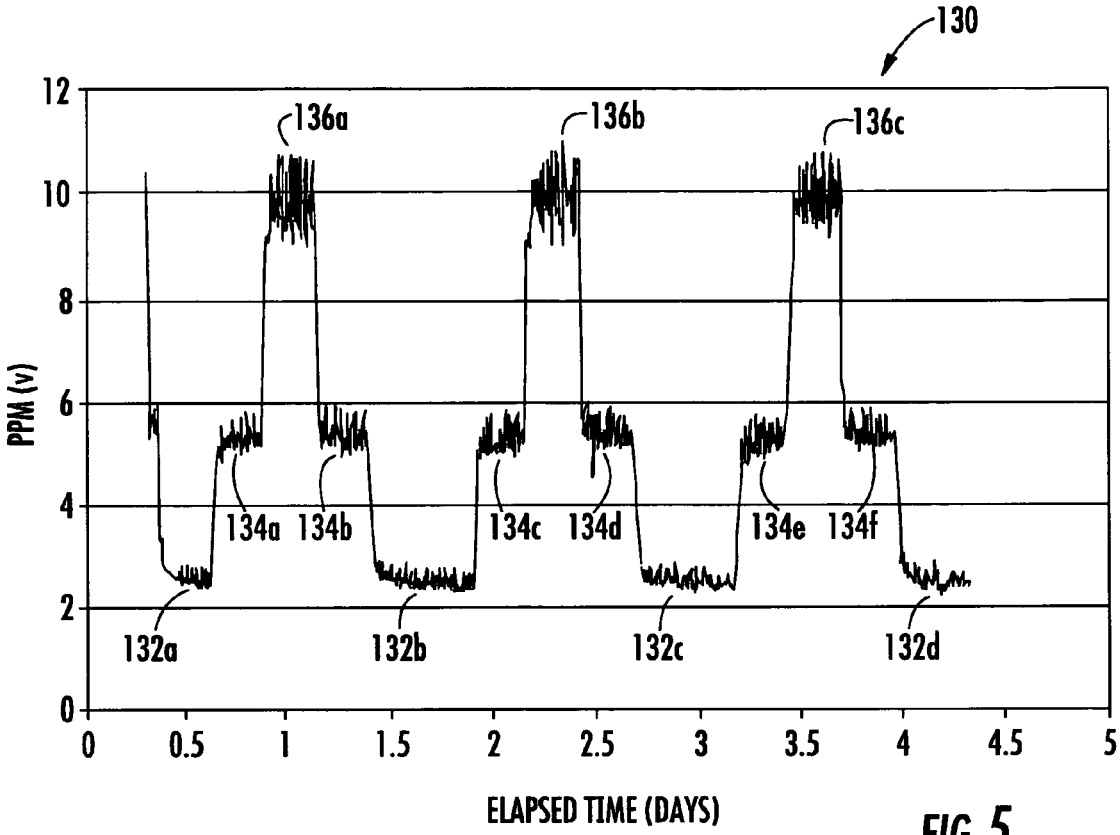
FIG. 5 is a graph showing variations in blended fluid volumetric ratios over time.

FIG. 5 illustrates typical performance of this Example 2 configuration. Dry argon was supplied as the second fluid, and water was used as the first fluid. The first fluid (water) temperature was set stepwise over several cycles at fixed values going from 39.8° C. to 52.6° C. to 62.3° C., and then back down to 52.6° C. and 39.8° C. Chart 130 of FIG. 5 depicts the volumetric mixture ratio of blended fluid produced by the system under those changes. When the first fluid temperature was set at 39.8° C. volumetric mixture ratios 132*a*-132*d* were measured. When the first fluid temperature was set at 52.6° C. volumetric mixture ratios 134*a*-134*f* were measured. When the first fluid temperature was set at 62.3° C. volumetric mixture ratios 136*a*-136*c* were measured. Chart 130 (FIG. 5) indicates that the system did not exhibit any significant hysteresis going from lower to higher first fluid temperatures or from higher to lower first fluid temperatures.

In a non-quantitative evaluation, the FEP permeation tube was removed from the controlled temperature reservoir and allowed to dry in the room air. After drying the system was again run with dry argon and with the tube exposed only to ambient air (no water reservoir). The moisture content was measured and some moisture content was observed, even though the permeation tube was not immersed in a liquid water reservoir. This indicates that permeation may occur either by a liquid-to-vapor mechanism or by a vapor-to-vapor mechanism. The vapor-to-vapor process will be at a much lower transfer rate but it is still temperature controlled.

The foregoing descriptions of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A system for providing blended fluids at a specified minimum delivery pressure, the system comprising:

a differential pressure regulator having a high pressure side, a low pressure side, and a pressure reference port;

a second fluid source containing a second fluid at a second fluid pressure, where the second fluid source is connected to the high pressure side of the differential pressure regulator;

at least one controlled temperature reservoir with each controlled temperature reservoir containing a first fluid at a controlled first fluid temperature;

an output line having an output line first end and an output line second end;

at least one fluid carrier with each fluid carrier having a permeable section and with each fluid carrier having a fluid carrier first end and a fluid carrier second end, where the fluid carrier first end of each fluid carrier is connected to the low pressure side of differential pressure regulator, and where a portion of each permeable section is immersed in at least one controlled temperature reservoir, and where the fluid carrier second end of each fluid carrier is connected to the output line first end, whereby as the second fluid passes through the portion of each permeable section of fluid carrier that is immersed in the first fluid in the controlled temperature reservoir, a portion of the first fluid passes through the permeable section of the fluid carrier and mixes with a portion of the second fluid forming a blended fluid that flows from the fluid carrier second end into the output line first end at a blended fluid output pressure;

a back pressure control valve tapped into the output line, where the back pressure control valve is set at a back pressure that is at least equal to the specified minimum delivery pressure; and a pilot tube having a pilot tube first end and a pilot tube second end, where the pilot tube first end is tapped into the output line, and the pilot tube second end is connected to the pressure reference port of the differential pressure regulator whereby the blended fluid output pressure remains substantially constant and blended fluid flows from the output line second end at a volumetric mixture ratio that is substantially determined by the first fluid temperature of each controlled temperature reservoir.

2. The fluid blending system of claim 1 comprising a plurality of fluid carriers.

3. The fluid blending system of claim 2 further comprising a manifold system.

4. The fluid blending system of claim 2 comprising at least one controlled temperature reservoir containing a first fluid at a fixed first fluid temperature.

5. The fluid blending system of claim 2 comprising at least one controlled temperature reservoir containing a first fluid at a first fixed first fluid temperature, and at least one controlled temperature reservoir containing a first fluid at a second fixed first fluid temperature different from the first fixed first fluid temperature.

6. The fluid blending system of claim 2 comprising at least one controlled temperature reservoir containing a first fluid at a variable first fluid temperature.

7. The fluid blending system of claim 1 comprising at least one controlled temperature reservoir containing a first fluid at a variable first fluid temperature.

8. The fluid blending system of claim 1 further comprising a process valve having a process valve input and a process valve output, where the process valve input is connected to the output line second end and the process valve output is connected to a process feed line.

9. The fluid blending system of claim 8 comprising a plurality of fluid carriers.

10. The fluid blending system of claim 8 comprising at least one controlled temperature reservoir containing a first fluid at a fixed first fluid temperature.

11. The fluid blending system of claim 9 comprising at least one controlled temperature reservoir containing a first fluid at a fixed first fluid temperature.

12. The fluid blending system of claim 9 comprising at least one controlled temperature reservoir containing a first fluid at a first fixed first fluid temperature, and at least one controlled temperature reservoir containing a first fluid at a second fixed first fluid temperature different from the first fixed first fluid temperature.

13. The fluid blending system of claim 9 comprising at least one controlled temperature reservoir containing a first fluid at a variable first fluid temperature.

14. The fluid blending system of claim 8 comprising at least one controlled temperature reservoir containing a first fluid at a variable first fluid temperature.

15. A method for providing an application process having an internal operating pressure with a blend of fluids having a specified volumetric flow rate and having a specified volumetric ratio of a second fluid in a mixture with a first fluid at a specified minimum delivery pressure, the method comprising:

controlling the temperature of the first fluid in a reservoir;

flowing the second fluid at a second fluid supply pressure into a permeable fluid carrier and passing the second fluid in the permeable fluid container through the reservoir;

thermally inducing permeation of a portion of the first fluid into the flow of the second fluid thereby producing a blended fluid flow exiting the permeable fluid carrier;

setting a blended fluid output pressure that is at least equal to the specified minimum delivery pressure;

maintaining a fixed pressure differential between the second fluid supply pressure and the blended fluid output pressure that is independent of the internal operating pressure of the application process; and flowing the blended fluid from the permeable fluid carrier to the application process.

16. The method of claim 15 wherein the volumetric ratio of the second fluid in the mixture with the first fluid is controlled by changing the temperature of the reservoir of the first fluid.

17. The method of claim 15 wherein the volumetric ratio of the second fluid in the mixture with the first fluid is controlled by changing the fixed pressure differential between the second fluid supply pressure and the blended fluid output pressure.

18. The method of claim 15 wherein the volumetric of the second fluid in the mixture with the first fluid is controlled by changing the blended fluid output pressure.

19. The method of claim 15 further comprising providing a standby mode when no portion of the blended fluid flow is needed by the process application; and providing an operational mode supplying the application process with blended fluid at a pressure that is equal to or greater than the specified minimum delivery pressure when blended fluid is needed by the process application.

* * * * *